US007546971B2

(12) United States Patent
Pappas

(10) Patent No.: US 7,546,971 B2
(45) Date of Patent: Jun. 16, 2009

(54) SYSTEM, APPARATUS AND METHOD FOR UNLOADING ROLLED MATERIAL FROM A SUPPORTING STRUCTURE

(75) Inventor: Michael Pappas, Denville, NJ (US)

(73) Assignee: Catbridge Machinery, L.L.C., Parsippany, NJ (US)

( * ) Notice: Subject to any disclaimer, the term of this patent is extended or adjusted under 35 U.S.C. 154(b) by 301 days.

(21) Appl. No.: 11/398,451

(22) Filed: Apr. 5, 2006

(65) Prior Publication Data

US 2006/0247111 A1 Nov. 2, 2006

Related U.S. Application Data

(60) Provisional application No. 60/668,924, filed on Apr. 6, 2005.

(51) Int. Cl.
*B65H 19/22* (2006.01)

(52) U.S. Cl. ..... 242/533.7; 414/911

(58) Field of Classification Search ..... 242/573, 242/533.2, 533, 533.7, 473.4, 473.5, 473.6, 242/559, 558, 561; 493/37; 414/908, 910, 414/911, 684, 470, 277, 279, 639
See application file for complete search history.

(56) References Cited

U.S. PATENT DOCUMENTS 2,198,644 A * 4/1940 Wettengel ..... 242/533.3
2,738,087 A 3/1956 Arnot
3,226,599 A 12/1965 Webb
3,718,302 A * 2/1973 Mount et al. ..... 242/533.3
3,847,366 A * 11/1974 Schmidt et al. ..... 242/533.7
3,877,595 A 4/1975 Edelman
3,905,496 A 9/1975 Reeder
4,165,052 A * 8/1979 Seibert ..... 242/470
4,204,650 A * 5/1980 Mengel ..... 242/527.4
4,208,019 A * 6/1980 Dusenbery ..... 242/527.2
4,209,140 A * 6/1980 Seibert ..... 242/559
4,236,626 A * 12/1980 Noe ..... 198/468.6
4,431,142 A * 2/1984 Kataoka ..... 242/533.3
4,541,769 A * 9/1985 Clemens ..... 414/633
4,553,899 A * 11/1985 Magni ..... 414/629
4,615,493 A * 10/1986 Teranishi et al. ..... 242/473.7
4,682,929 A * 7/1987 Kataoka ..... 414/589
4,722,657 A * 2/1988 Grube ..... 414/331.06
5,158,639 A 10/1992 Washizaki
5,180,269 A * 1/1993 Nishioka ..... 414/331.01
5,332,351 A * 7/1994 Nelson et al. ..... 414/684
5,400,720 A 3/1995 Stevens
5,505,406 A 4/1996 Summey, III
5,544,719 A 8/1996 Boriani et al.
5,601,014 A 2/1997 Stevens et al.
5,658,124 A 8/1997 Presnell, III (Continued)

*Primary Examiner*—Peter M Cuomo
*Assistant Examiner*—Juan J Campos
(74) *Attorney, Agent, or Firm*—Edwards Angell Palmer & Dodge LLP

(57) ABSTRACT

The invention provides an apparatus for unloading rolled material from a cantilevered support mandrel including a first guide rail extending generally parallel to the cantilevered support mandrel, a second guide rail extending generally perpendicularly to the cantilevered support mandrel, and a carrier for receiving rolled material from the mandrel, the carrier being adapted and configured for movement along the first axis relative to the support mandrel and generally vertical movement along the second guide rail relative to the support mandrel. The invention also provides a method of unloading rolled material from a cantilevered support mandrel.

23 Claims, 21 Drawing Sheets

U.S. PATENT DOCUMENTS 5,674,049 A * 10/1997 Pienta et al. ..... 414/798.7
5,700,126 A * 12/1997 Sohma et al. ..... 414/416.05
5,743,703 A 4/1998 Nakajima
5,797,557 A * 8/1998 Wang et al. ..... 242/473.6
6,035,972 A 3/2000 Beattie
6,047,915 A * 4/2000 Jaschke ..... 242/473.9
6,199,789 B1 * 3/2001 Marco ..... 242/533.7
6,260,787 B1 * 7/2001 Michel et al. ..... 242/530.4
6,478,529 B1 11/2002 Willey et al.
6,604,704 B2 * 8/2003 Kiprowski ..... 242/559.1
6,655,629 B1 * 12/2003 Acciari ..... 242/533
6,692,210 B1 * 2/2004 Ettelbruck ..... 414/222.01
7,097,129 B2 * 8/2006 Matthies ..... 242/473.5
2003/0034419 A1 * 2/2003 Joutsjoki ..... 242/533.7
2004/0041056 A1 * 3/2004 Beccari ..... 242/559

* cited by examiner

SYSTEM, APPARATUS AND METHOD FOR UNLOADING ROLLED MATERIAL FROM A SUPPORTING STRUCTURE

CROSS-REFERENCE TO RELATED APPLICATIONS

This application claims priority to U.S. Provisional Patent Application Ser. No. 60/668,924 filed on Apr. 6, 2005 which is incorporated by reference herein in its entirety.

BACKGROUND OF THE INVENTION

1. Field of the Invention

The present invention relates to an apparatus for unloading rolled material. Particularly, the present invention is directed to an apparatus and method for unloading rolled material from a cantilevered support mandrel.

2. Description of Related Art

A variety of unloading devices are known in the art for unloading or relocating rolled material. Of such devices, many are directed to unloading devices including a carrier, which moves or unloads the rolled material after the mandrel on which the rolled material is wound retracts from the rolled material.

For decades the converting industry has employed slitting machinery to convert webs of paper, foam, fabrics, nonwovens, tape, and other materials into desired widths. Once converted, the finished material is wound into relatively large rolls that are supported on a mandrel of a rewind stand or a similar apparatus. In general, the rolls of finished material are relatively heavy and require special handling equipment to facilitate their removal from the rewind stand. The prior art is replete with handling equipment for this purpose.

One example is the invention of U.S. Pat. No. 6,260,787 to Michel et al., the disclosure of which is incorporated herein by reference in its entirety. The invention in Michel provides a carrier which supports the rolled material while the mandrel on which the rolled material retracts. Once the mandrel has fully retracted, the rolled material is then removed via the carrier.

Other examples include unloading devices that include a v-shaped carrier for accommodating the rolled material. Many of these v-shaped carriers rotate to facilitate unloading the rolled material from a support structure, moving it to a conveyance, and then unloading the rolled material by rolling it onto the conveyance. Examples of this type of device include U.S. Pat. No. 3,905,496 to Reeder, U.S. Pat. No. 5,158,639 to Washizaki, and U.S. Pat. No. 5,400,720 to Stevens.

Further examples of unloading devices for rolled material are of the general type of a hand truck or forklift configuration, as exemplified by U.S. Pat. No. 5,743,703 to Nakajima.

Such conventional systems generally have been considered satisfactory for their intended purpose. However, it is well known that such systems have limitations as to the width and weight of the rolls they can readily handle. The apparatus, systems and methods disclosed herein overcome these and other disadvantages.

SUMMARY OF THE INVENTION

The purpose and advantages of the present invention will be set forth in and apparent from the description that follows. Additional advantages of the invention will be realized and attained by the methods and systems particularly pointed out in the written description and claims hereof, as well as from the appended drawings.

To achieve these and other advantages and in accordance with the purpose of the invention, as embodied herein and broadly described, the invention includes an apparatus for unloading rolled material from a cantilevered support mandrel defining a first axis. The apparatus includes a first guide rail extending generally parallel to the cantilevered support mandrel. The apparatus further includes a second guide rail extending generally perpendicularly to the cantilevered support mandrel. The apparatus also includes a carrier for receiving rolled material from the mandrel, the carrier being adapted and configured for movement along the first and second guide rails.

In accordance with a further aspect of the invention, the apparatus can further comprise a third guide rail, wherein the third guide rail is generally parallel to the second guide rail, and wherein the carrier is adapted and configured for generally vertical movement along the second and third guide rails.

In accordance with another aspect of the invention, the carrier can be adapted and configured to be positioned underneath the rolled material to facilitate removal of the rolled material from the cantilevered support mandrel.

In accordance with still another aspect of the invention, an apparatus is provided including a roll transfer cart adapted to transport the rolled material from the roll transfer apparatus to a location remote from the roll transfer apparatus, wherein the controller is programmable to eject the rolled material from the carrier onto the cart.

The invention also includes a method for unloading rolled material from a cantilevered support mandrel defining a first axis. The method includes a step of moving a carrier along a generally vertical direction to a height lower than the height of the bottom of the rolled material. The method also includes a step of moving the carrier along the first axis to a position below the rolled material. The method includes a step of moving the carrier vertically upward into contact with the rolled material to support the weight of the rolled material. The method further includes removing the rolled material from the cantilevered support mandrel by moving the carrier horizontally away from the mandrel along the first axis.

In further accordance with the invention, the method can further include the step of ejecting the rolled material from the carrier by rotating the carrier about an axis parallel to an axis of the rolled material.

In still further accordance with the invention, the step of ejecting can include ejecting the rolled material onto a transfer cart.

The invention also includes a machine readable program for controlling a roll transfer apparatus for unloading rolled material from a cantilevered support mandrel. The machine readable program includes means for operating the roll transfer apparatus to remove the rolled material from the cantilevered support mandrel using the carrier.

It is to be understood that both the foregoing general description and the following detailed description are exemplary and are intended to provide further explanation of the invention claimed.

The accompanying drawings, which are incorporated in and constitute part of this specification, are included to illustrate and provide a further understanding of the method and system of the invention. Together with the description, the drawings serve to explain the principles of the invention.

DETAILED DESCRIPTION OF THE PREFERRED EMBODIMENT

Reference will now be made in detail to the present preferred embodiments of the invention, an example of which is illustrated in the accompanying drawings. The method and corresponding steps of the invention will be described in conjunction with the detailed description of the system.

The devices, methods, and machine-readable programs presented herein may be used for unloading rolled material. The present invention is particularly suited for unloading rolled material from a cantilevered support mandrel, such as the cantilevered support mandrel of a rewind stand or other support structure.

In accordance with the invention, a system for unloading rolled material from a support mandrel is provided, which includes, among other things, a carrier for receiving rolled material from the mandrel, the carrier being mounted for movement along a horizontal axis to remove one or more rolls of rolled material from a supporting mandrel and subsequently transport the rolled material to a spaced location, wherein the carrier is adapted to deposit the rolled material at the spaced location. In one embodiment of the subject invention, the spaced location is a conveyor upon which the rolled material is deposited. In another embodiment of the subject invention, the spaced location is a roll transfer cart upon which the wound rolls of material are deposited, and which subsequently transports the wound rolls to a conveyor where they are subsequently deposited.

Preferably, the carrier has a contoured support surface for accommodating one or more rolls of rolled material and a pusher arm is preferably associated with the carrier to strip the rolled material from the supporting mandrel as the carrier moves along the horizontal axis. Preferably, the carrier is mounted for movement along a vertical axis to readily position the carrier relative to the rolled material, the conveyor, and/or the cart during the unloading process.

Figure 1:
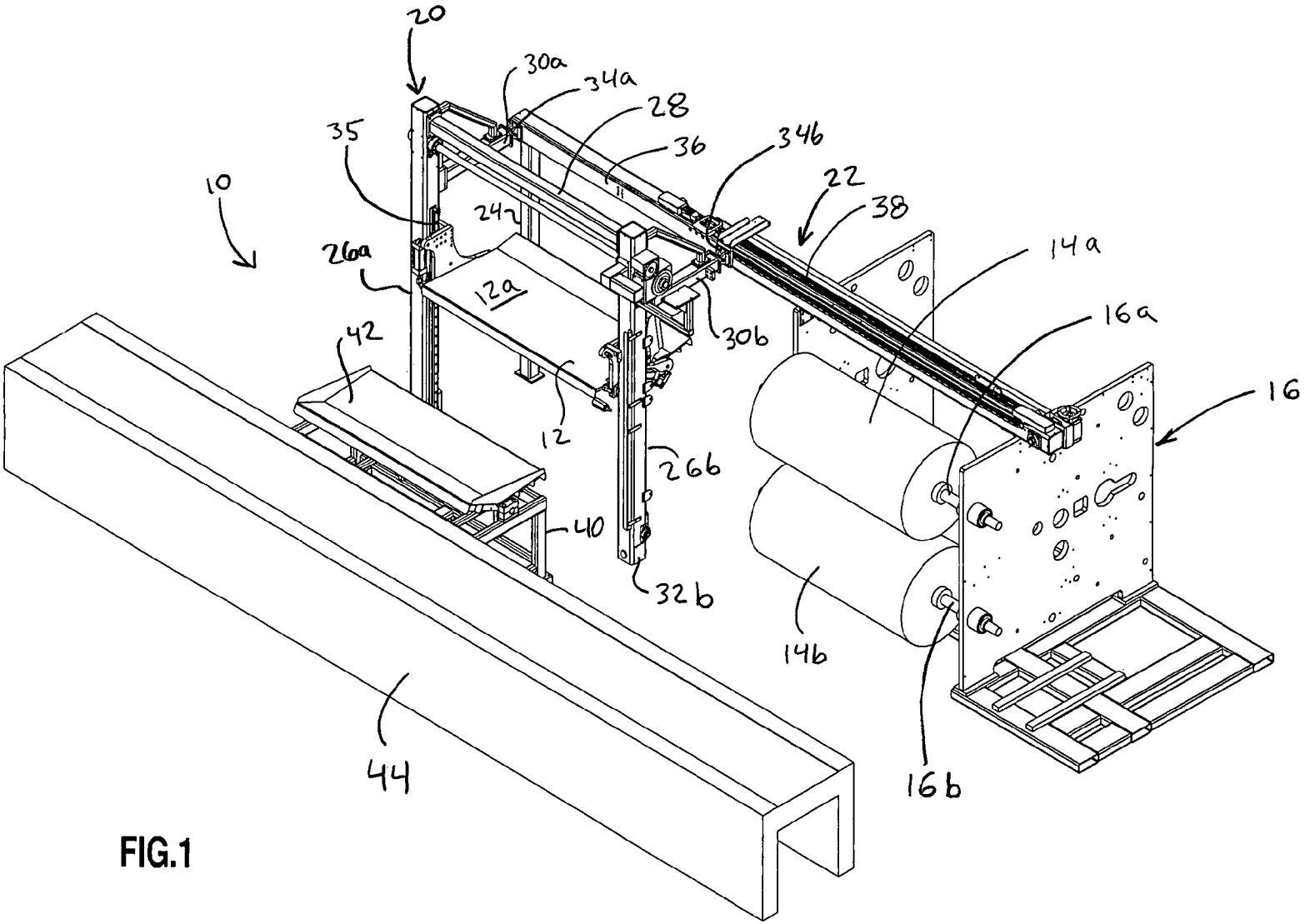
FIG. 1 is an isometric view of a portion of a first representative embodiment of an apparatus for unloading rolled material from a cantilevered support mandrel in accordance with the present invention, at a first step of operation.

For purpose of explanation and illustration, and not limitation, a partial view of an exemplary embodiment of the apparatus in accordance with the invention is shown in FIG. 1 and is designated generally by reference character 10. In the description that follows, reference will be made to a series of drawings, which illustrate the system and apparatus of the subject invention and the way in which it functions. For ease of illustration and as a matter of convenience, the subject invention is shown with full-width rolls of rolled material that are initially supported on upper and lower mandrels of a rewind stand. While such a roll configuration can exist in certain converting applications, it is not common. It is more common that the mandrels of the rewind stand each support a plurality of spaced apart rolls of rolled material that have been previously converted from a web of material by slitting machinery. In such instances, the wound rolls of the upper mandrel have staggered spacing relative to the wound rolls on the lower mandrels (i.e., the upper mandrel would have a roll-space-roll-space configuration, or vice-versa). Accordingly, while the subject invention is illustrated with full-width rolls for mere convenience, those skilled in the art should recognize that the rolls of material described herein can actually be multi-cut rolls.

Referring now to the drawings wherein like reference numerals identify similar aspects or features of the system and/or apparatus of the subject invention, there is illustrated in FIG. 1, a system for handling wound rolls of finished material, which is constructed in accordance with a preferred embodiment of the subject invention and is designated generally by reference numeral 10. FIGS. 2-17 illustrate other aspects of the embodiment of FIG. 1 in different positions of operation. It will be recognized by those of skill in the art that the order of steps illustrated by FIGS. 1-17 is not restrictive, and that the order of particular steps of operation can be varied.

In brief, the material handling system 10 of the subject invention includes a remotely controlled, computer programmable, mechanized carrier, or unload table 12, that is adapted and configured to translate or otherwise move along or relative to multiple axes/planes, to facilitate the acquisition, removal, transport and disposition of one or more rolls 14*a*, 14*b* of finished material initially supported on a rewind stand 16 or a similar roll supporting apparatus.

In the subject disclosure, the rewind stand 16 includes, among other features, a pair of vertically spaced apart, horizontally disposed elongate mandrels 16*a*, 16*b*, each for supporting one or more rolls of wound material 14*a*, 14*b*. While not shown in the drawings, during a winding process, the elongate mandrels 16*a*, 16*b* are typically supported on their driving ends by bearings that are located in a fixed housing and on their driven ends by bearings and retractable supports. The retractable supports are disengaged to facilitate unloading and permit the mandrels to be cantilevered so that wound rolls can be readily stripped therefrom.

Also associated with the system 10 of the subject invention, is an operator station 50 (shown in FIGS. 18-21), which preferably includes, among other things, a computer terminal 52 including a programmable controller 54, supported by a graphical user interface or control panel 56, that permits a user to remotely operate the mechanical carrier, or unload table 12, and other components of the system and apparatus of the subject invention.

The mechanized carrier, or unload table 12, can have a platform 12*a* that is concave, contoured or otherwise generally V-shaped in configuration so as to accommodate or otherwise support a roll of finished material loaded thereon. The unload table 12 is mounted for movement relative to a supporting frame 20 that includes a main horizontal support beam 22, a vertical support beam 24 and two parallel vertical support rails 26*a*, 26*b*.

The main horizontal support beam 22 acts as a guide rail for guiding the unload table 12 toward and away from the mandrel 16*a*. As depicted, beam 22 extends along a direction that is generally parallel to cantilevered support mandrel 16*a*.

The vertical support rails 26*a*, 26*b* each act as guide rails for guiding vertical travel of unload table 12. As depicted, support rails 26*a*, 26*b* extend generally perpendicularly to support mandrel 16*a*. The vertical support rails 26*a*, 26*b* are connected to one another by a horizontal cross-beam 28 and two parallel struts 30*a*, 30*b*connect the vertical support rails 26*a*, 26*b* to the main support beam 22. The vertical support rails 26*a*, 26*b* each have a caster 32*a*, 32*b* (see FIG. 2) mounted in the bottom end thereof to facilitate translation over a supporting surface, which can be one or more guide tracks. It will be recognized that vertical support rails 26*a*, 26*b* need not be perfectly vertical as long as the direction of travel of unload table 12 is generally perpendicular to the cantilevered support mandrel 16*a*.

As further depicted, struts 30*a*, 30*b* are connected to respective guide plates 34*a*, 34*b*, and to one another by a spacer bar 36. Guide plates 34*a*, 34*b* are mounted for controlled movement along the main support beam 22, and this movement is effectuated by a linear drive system such as, for example, a system employing one or more motion controlled drive belts or drive chains 38 housed within the main support beam 22. Horizontal translation of the two guide plates 34*a*, 34*b*, and hence the vertical supports 26*a*, 26*b* connected thereto, effectuates the horizontal or side-to-side lateral movement of the unload table 12 in the course of unloading rolled material from the rewind stand 16, as discussed in more detail herein below. Vertical translation of the carrier or unload table 12 between raised and lowered positions is effectuated by a linear drive system 35 housed within one or both of the vertical supports 26*a*, 26*b*.

The apparatus for unloading rolled material, or material handling system 10, of the subject invention can further include a remotely controlled roll transfer cart 40 having a generally V-shaped support table 42 adapted and configured to pivot about a fixed horizontal axis. The roll transfer cart 40 preferably translates along a pair of parallel tracks (not shown), which are preferably flush-mounted in the floor. These tracks permit the roll transfer cart 40 to transfer rolled material from the unload table 12 to an adjacent conveyor belt 44 in the course of unloading rolled material from the rewind stand 16, as discussed in more detail herein below.

Referring now to FIGS. 1 through 17, in sequential order, when the material handling system 10 of the subject invention is at rest, roll transfer cart 40 is disposed in a start position adjacent the conveyor belt 44, with the support table 42 disposed in a receiving position. At such a time, the unload table 12 is disposed in a start position, spaced from the rewind stand 16 and aligned with the roll transfer cart 40.

Figure 2:
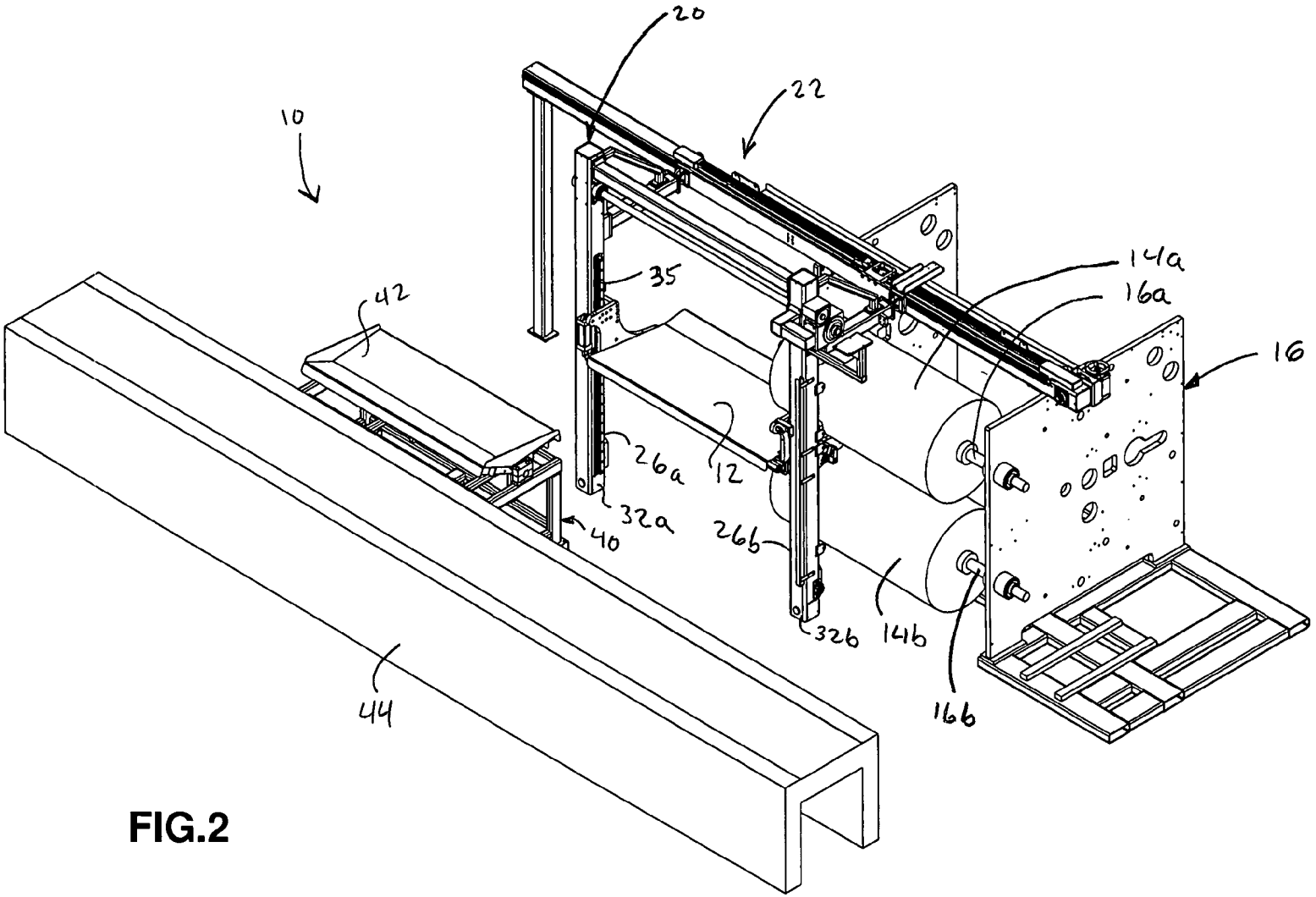
FIG. 2 is an isometric view of the embodiment of FIG. 1 at a second step of operation.
Figure 3:
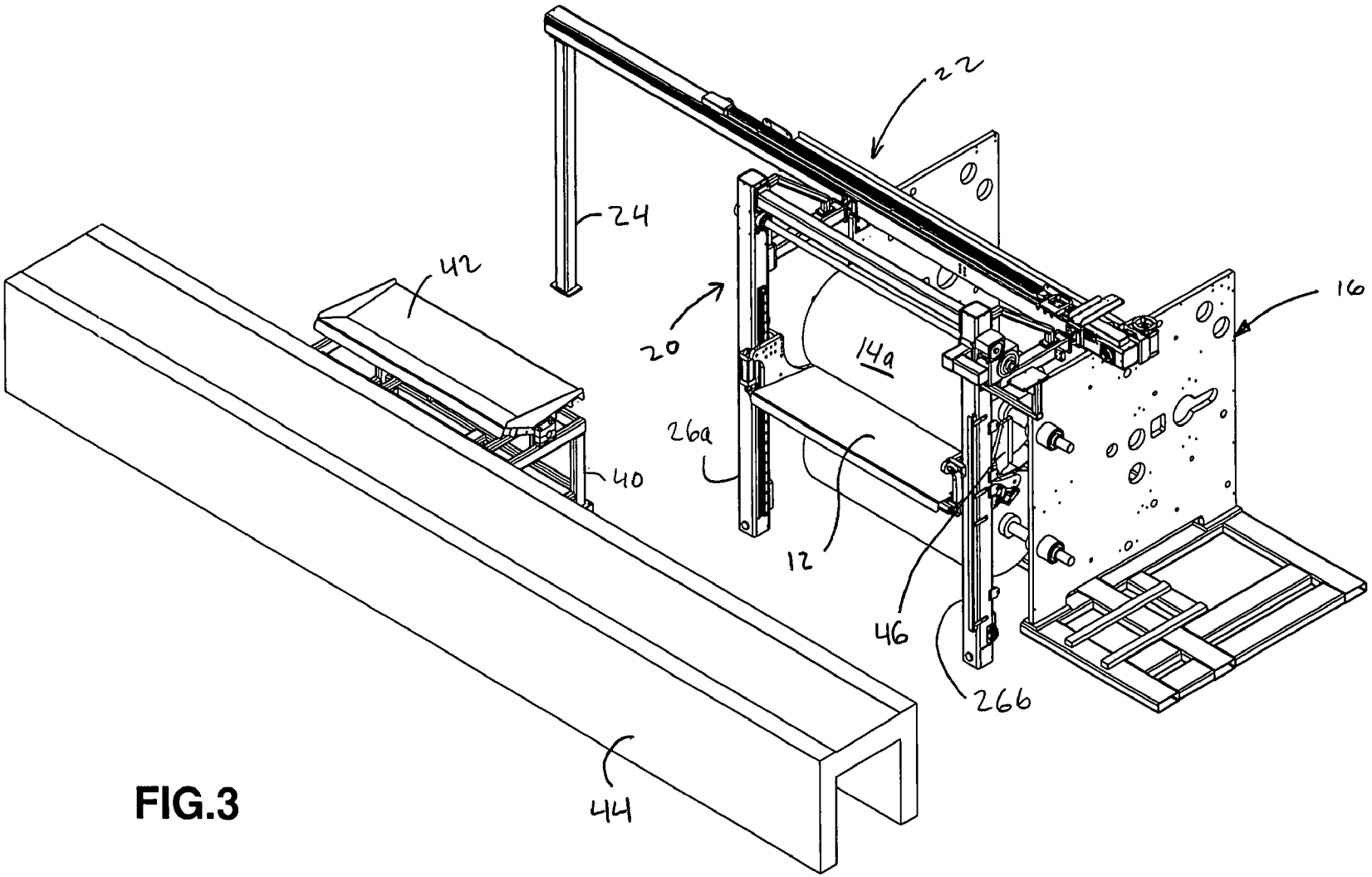
FIG. 3 is an isometric view of the embodiment of FIG. 1 at a third step of operation.

Referring to FIG. 2, at the beginning of the unloading sequence, the unload table 12 is raised or lowered to a height that enables it to pass between rolled material 14*a*, 14*b*, before or while it moves toward the rolls. Then, as shown in FIG. 3, the unload table 12 is moved between rolled material 14*a*, 14*b*. At such a time, the unload table 12 is vertically raised until a proximity switch (not shown) in the mandrel support arm senses that the upper mandrel 16*a* has been lifted slightly. Preferably, the unload table 12 is then lowered approximately ½ inch so that the mandrel support arm is once again supporting the elongate mandrel 16*a*. Thereupon, the rolled material 14*a* is not in contact with the unload table 12.

Figure 4:
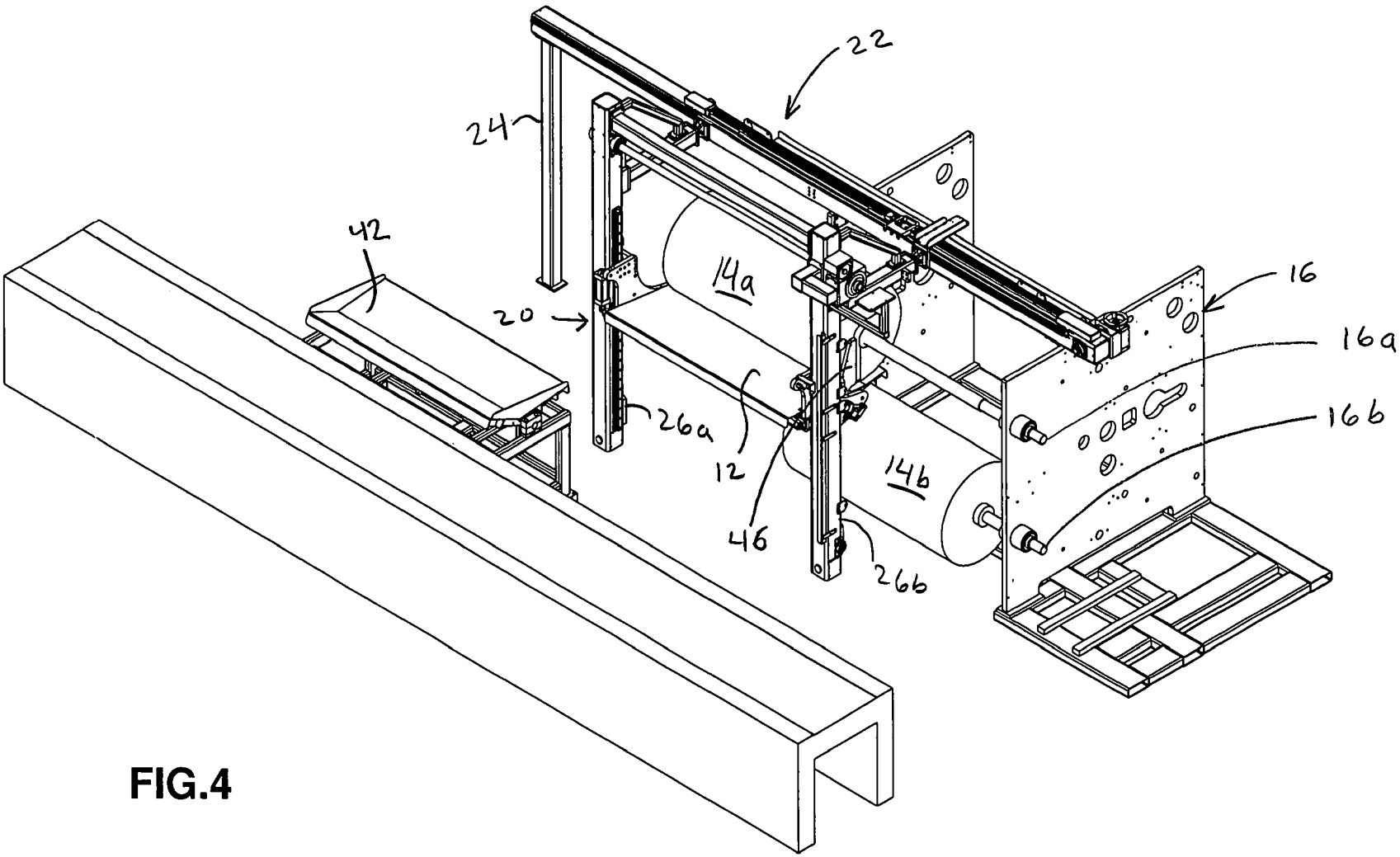
FIG. 4 is an isometric view of the embodiment of FIG. 1 at a fourth step of operation.

At this point in the unloading process, a roll pusher arm 46 associated with the vertical support beam 26*b* is moved from a retracted position into an operative position beside the rolled material 14*a* on the upper mandrel 16*a*. Then, as shown in FIG. 4 (and FIGS. 19-21, for example), the unload table 12 translates laterally away from the rewind stand 16 along its horizontal axis, whereupon the roll pusher arm 46 begins to strip the rolled material 14*a* from mandrel 16*a*. By using the roll pusher arm 46 in this manner, the outer surface of the rolled material 14*a* is not used as the means to strip the rolls, which could potentially cause the rolls to telescope or cause damage to the outer wraps.

Pusher arm 46 is adapted and configured to rotate about a pivot 46*a* (along the direction of arrow "A") into contact with a side of the rolled material. Pivot 46*a* can serve to connect pusher arm 46 with unload table 12 or vertical rail 26*b*, as desired. Pivoting permits arm 46 to pass by rolled material 14*a* as unload table 12 moves past the rolled material. A sensor 46*b* mounted in arm 46 senses when arm 46 has passed by rolled material 14*a*, thereby permitting arm 46 to rotate about pivot 46*a* and into contact with rolled material 14*a*.

Figure 19:
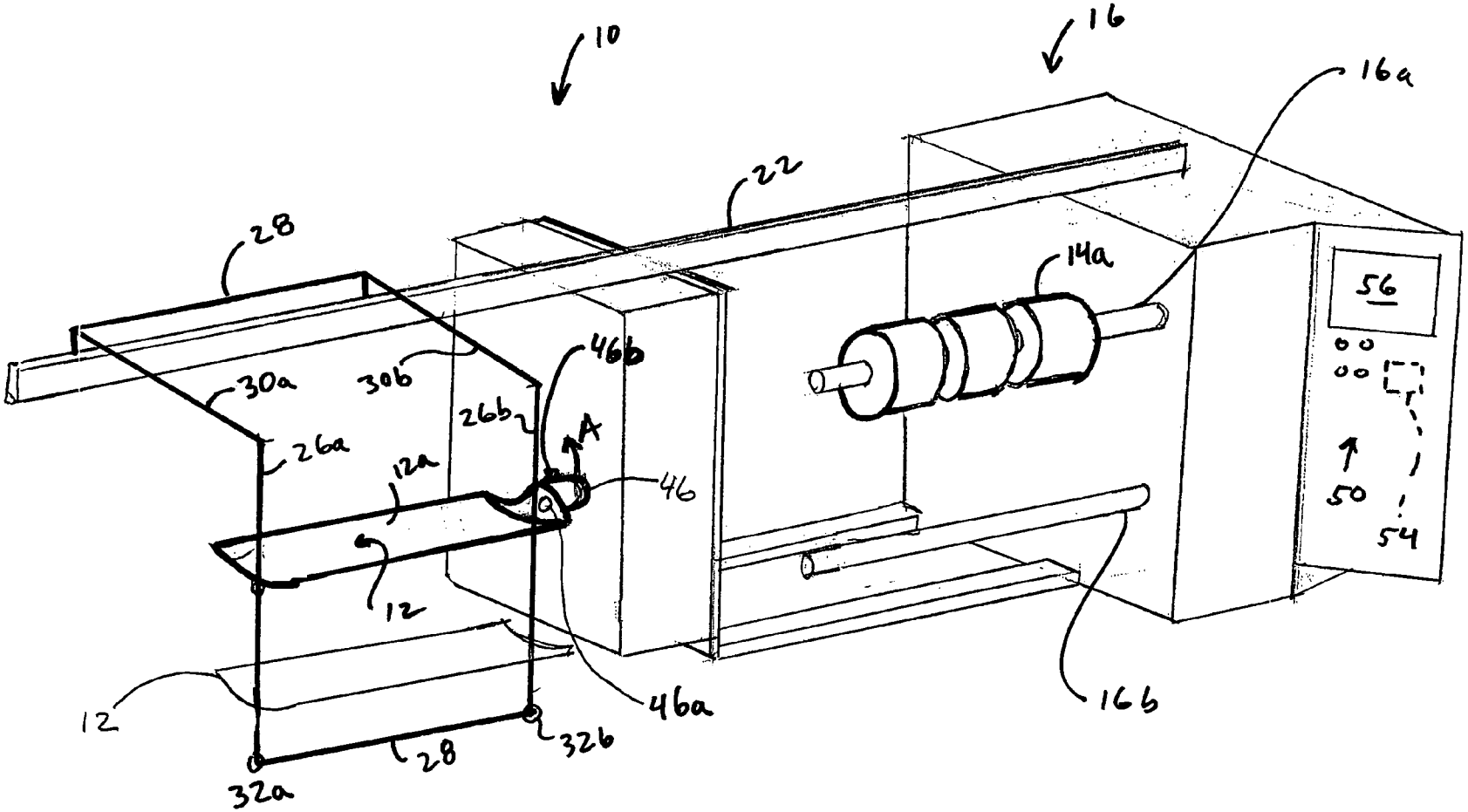
FIG. 19 is a view of another embodiment of a device made in accordance with the invention before unloading a roll of rolled material.
Figure 20:
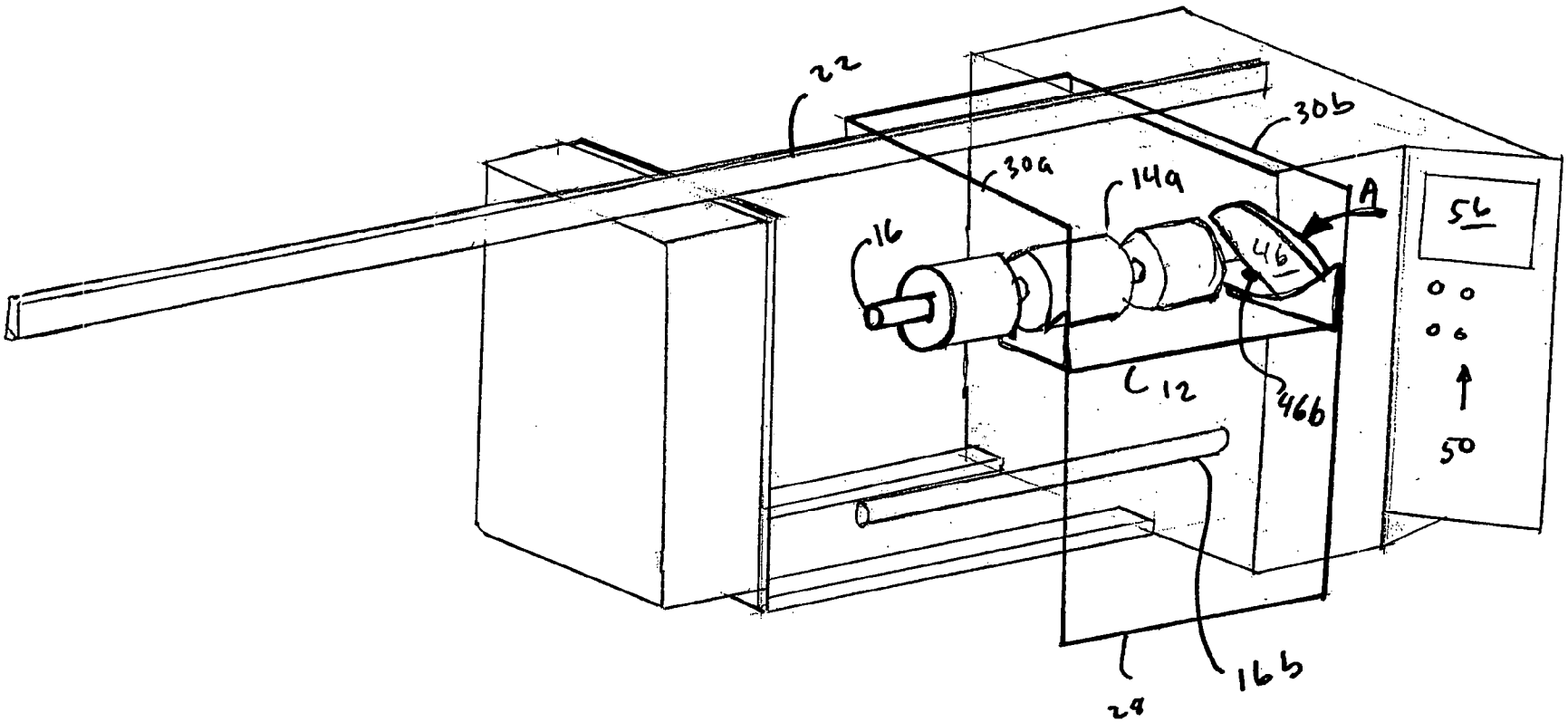
FIG. 20 is a view of the embodiment of FIG. 19 immediately prior to removing rolled material from a mandrel with a pusher arm rotated into contact with the rolled material.
Figure 21:
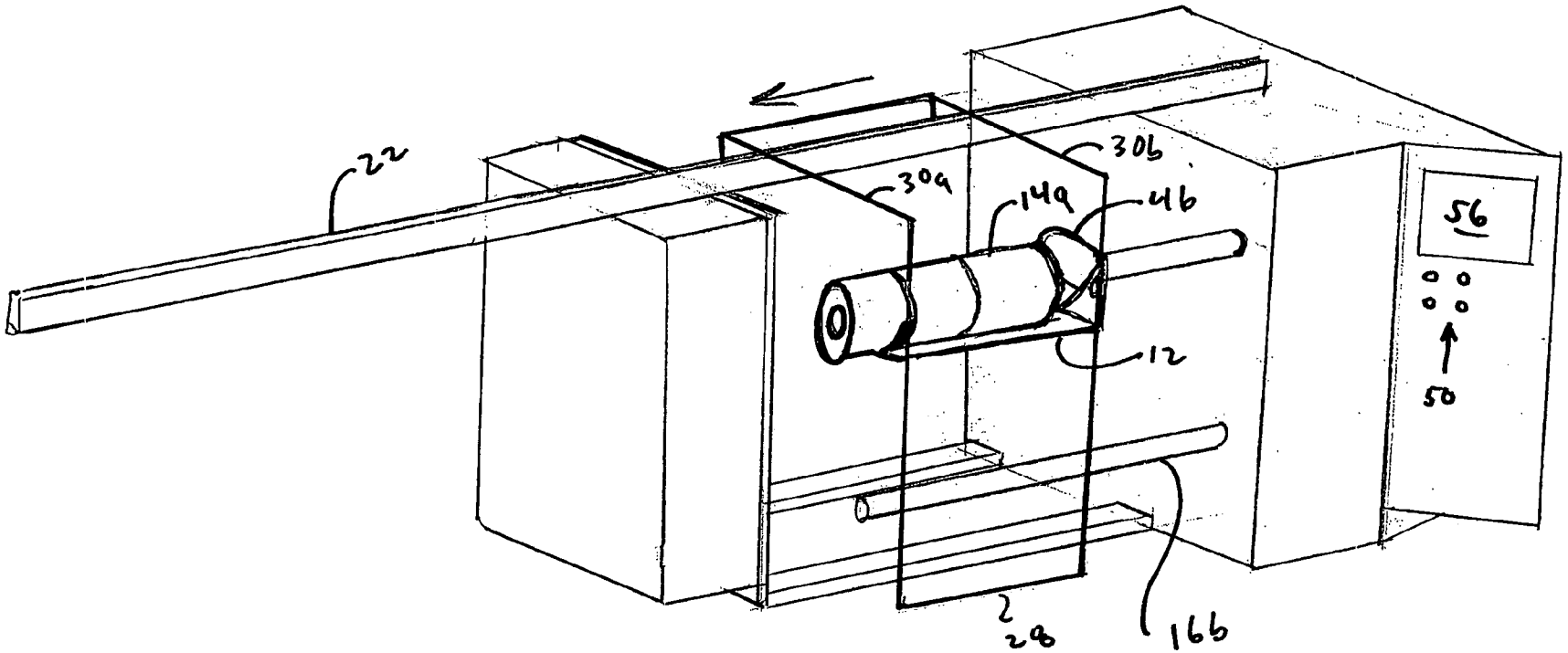
FIG. 21 is a view of the embodiment of FIG. 19 while pushing rolled material off of the mandrel using a pusher arm.

In the case of a plurality of spaced apart wound rolls of material as depicted in FIGS. 19-21, for example, as the pusher arm 46 and unload table 12 move laterally, the multiple spaced rolls 14*a* can be gathered together. At this point, lateral motion stops and the unload table 12 is raised to support the rolled material 14*a*. Once sensors signal that the rolled material is supported by the unload table 12, the mandrel end support (not shown) is retracted. The lateral stripping motion then resumes to complete removal of the rolled material 14*a* from the mandrel 16*a*. In this way, the mandrel 16*a* never independently supports the weight of the rolled material in a cantilevered fashion. Instead, the unload table 12 supports the rolled material 14*a* before the mandrel end support is retracted.

Figure 5:
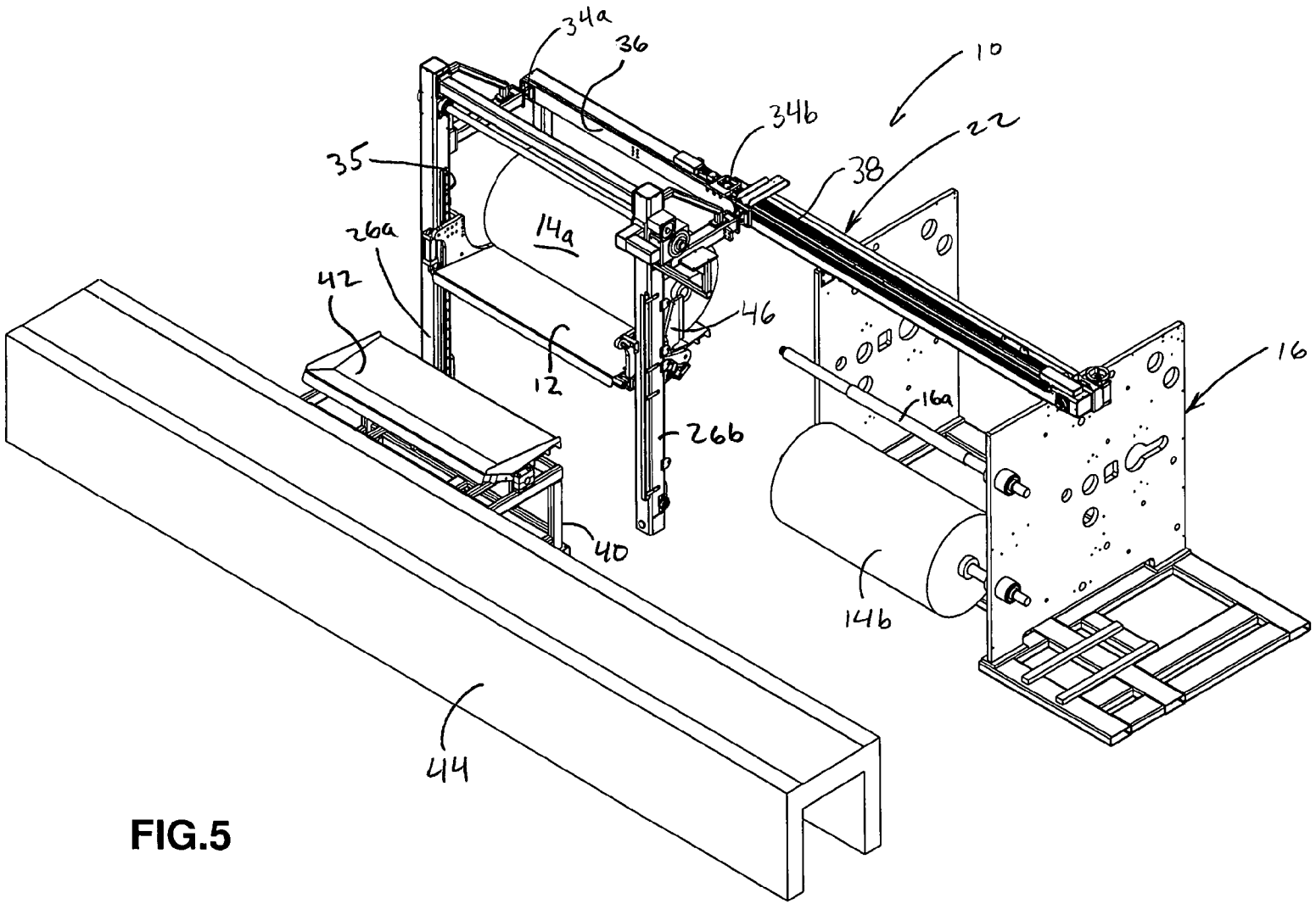
FIG. 5 is an isometric view of the embodiment of FIG. 1 at a fifth step of operation.
Figure 6:
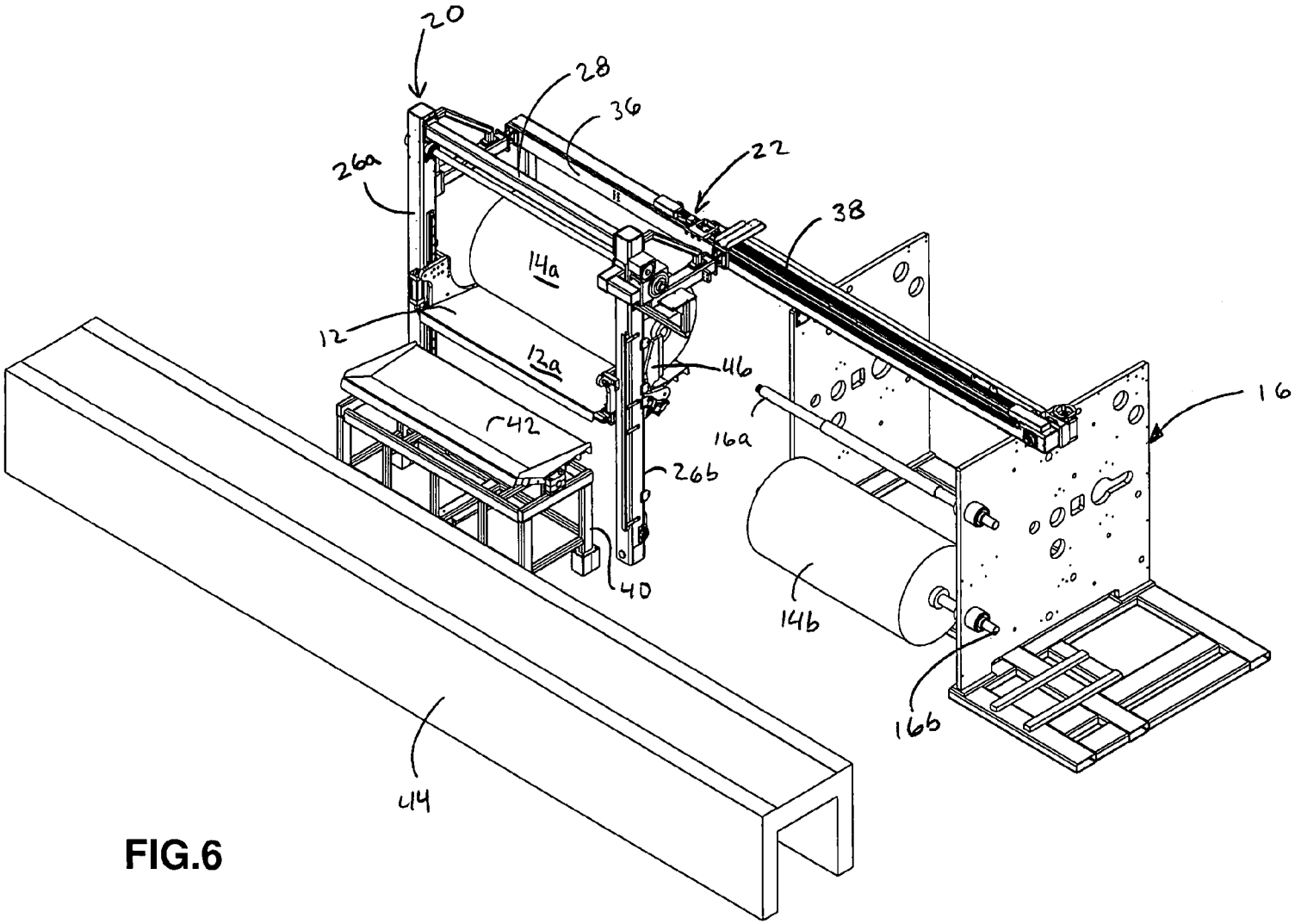
FIG. 6 is an isometric view of the embodiment of FIG. 1 at a sixth step of operation.
Figure 7:
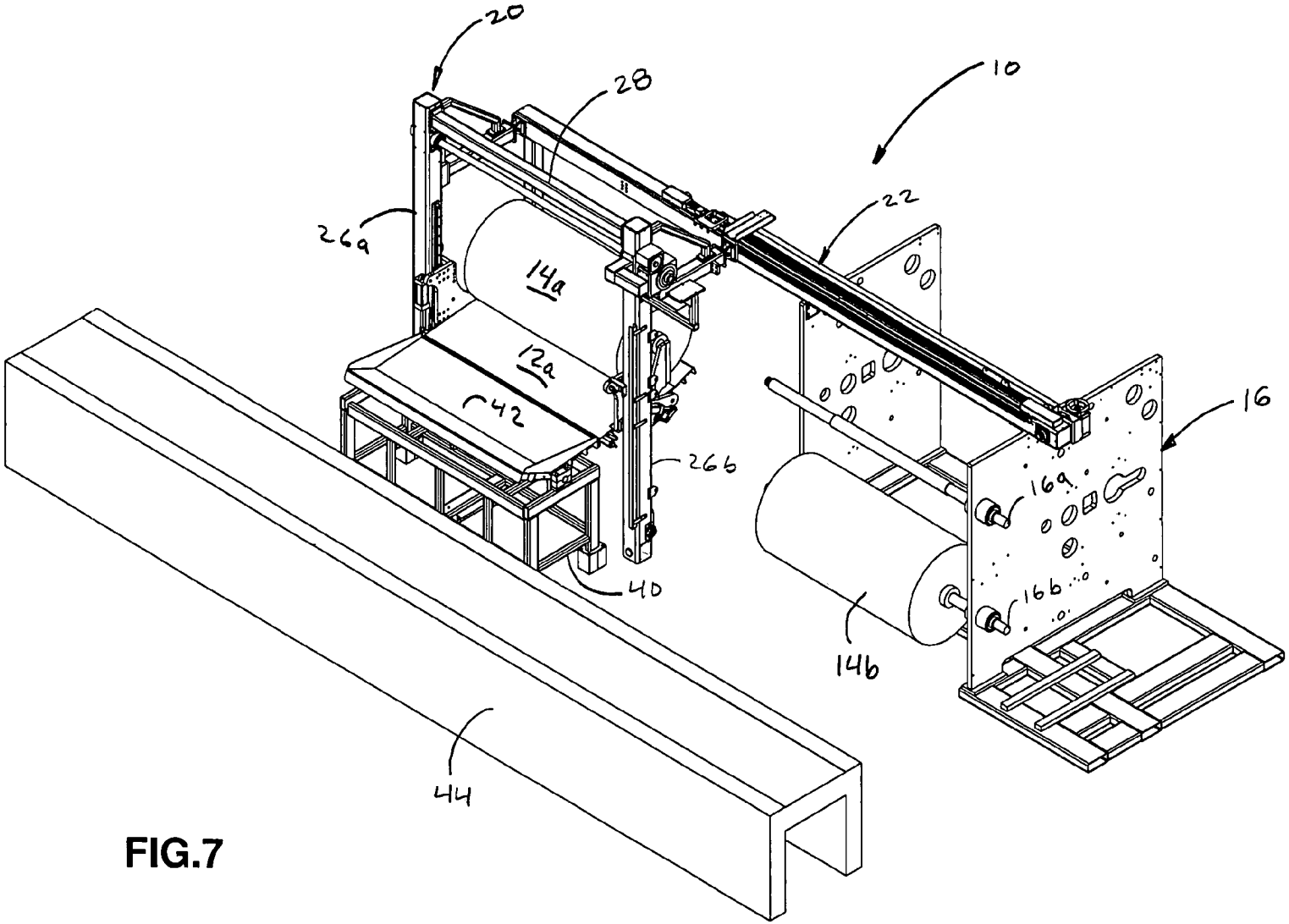
FIG. 7 is an isometric view of the embodiment of FIG. 1 at a seventh step of operation.
Figure 8:
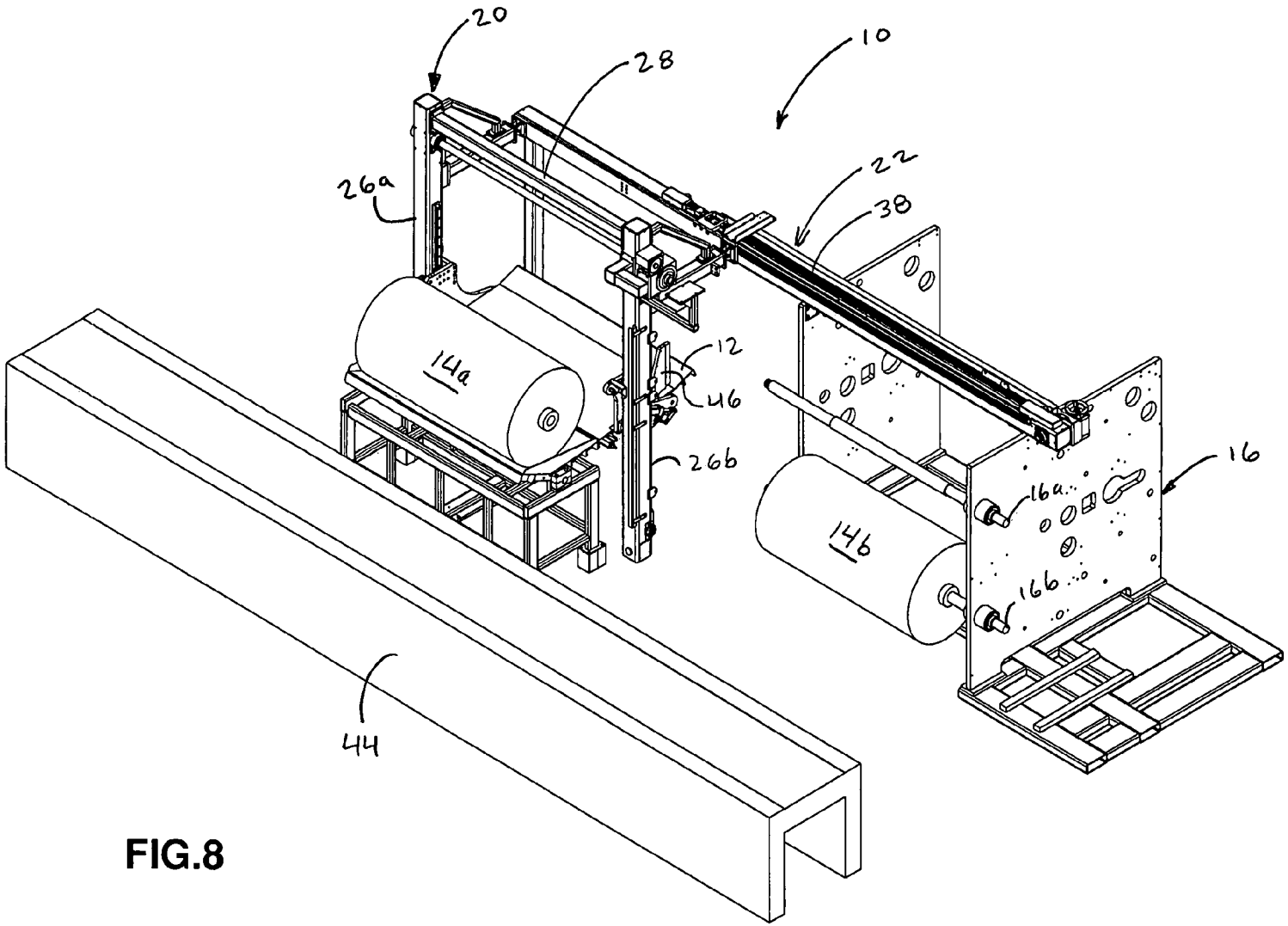
FIG. 8 is an isometric view of the embodiment of FIG. 1 at an eighth step of operation.
Figure 9:
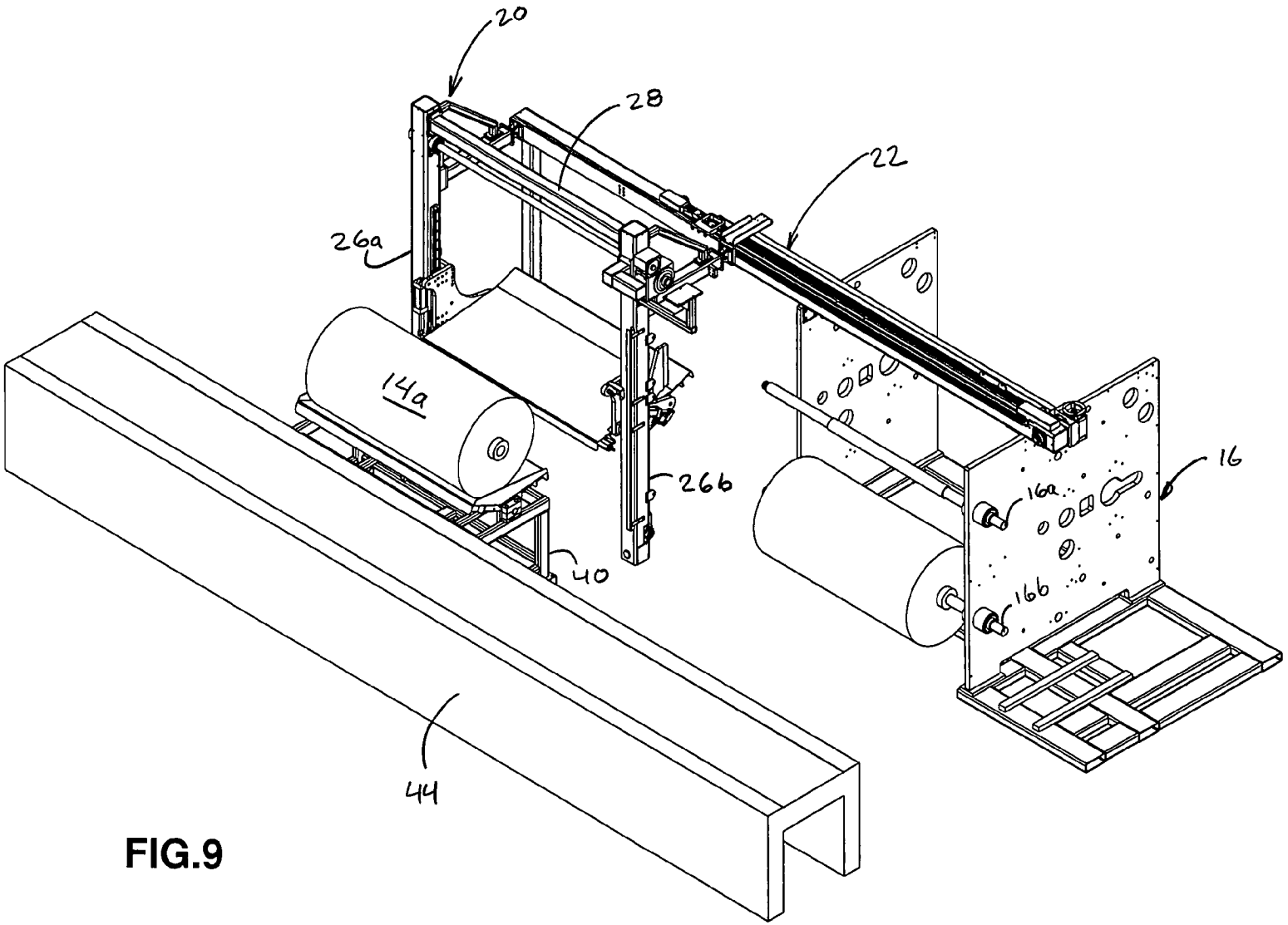
FIG. 9 is an isometric view of the embodiment of FIG. 1 at a ninth step of operation.
Figure 10:
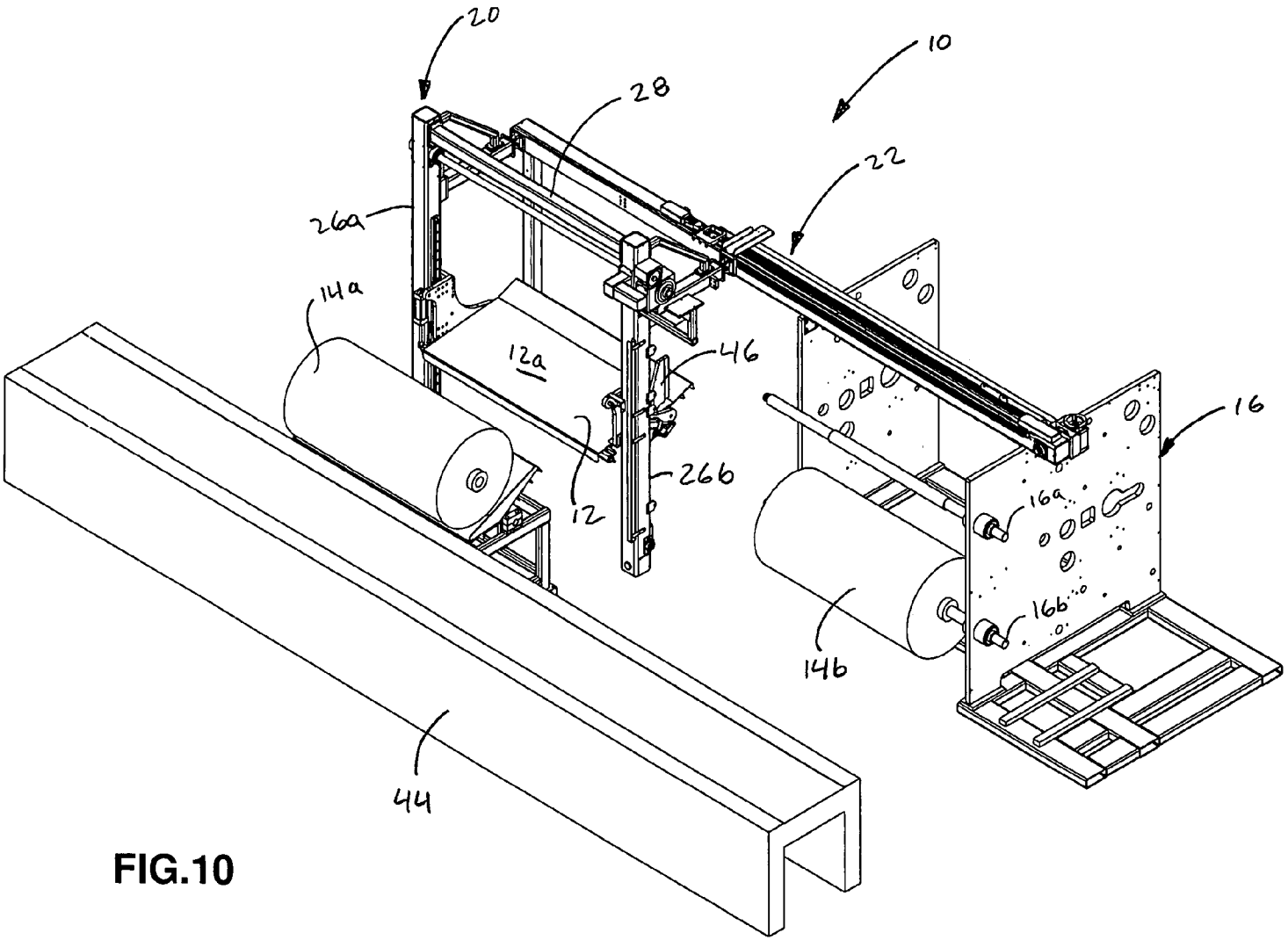
FIG. 10 is an isometric view of the embodiment of FIG. 1 at a tenth step of operation.
Figure 11:
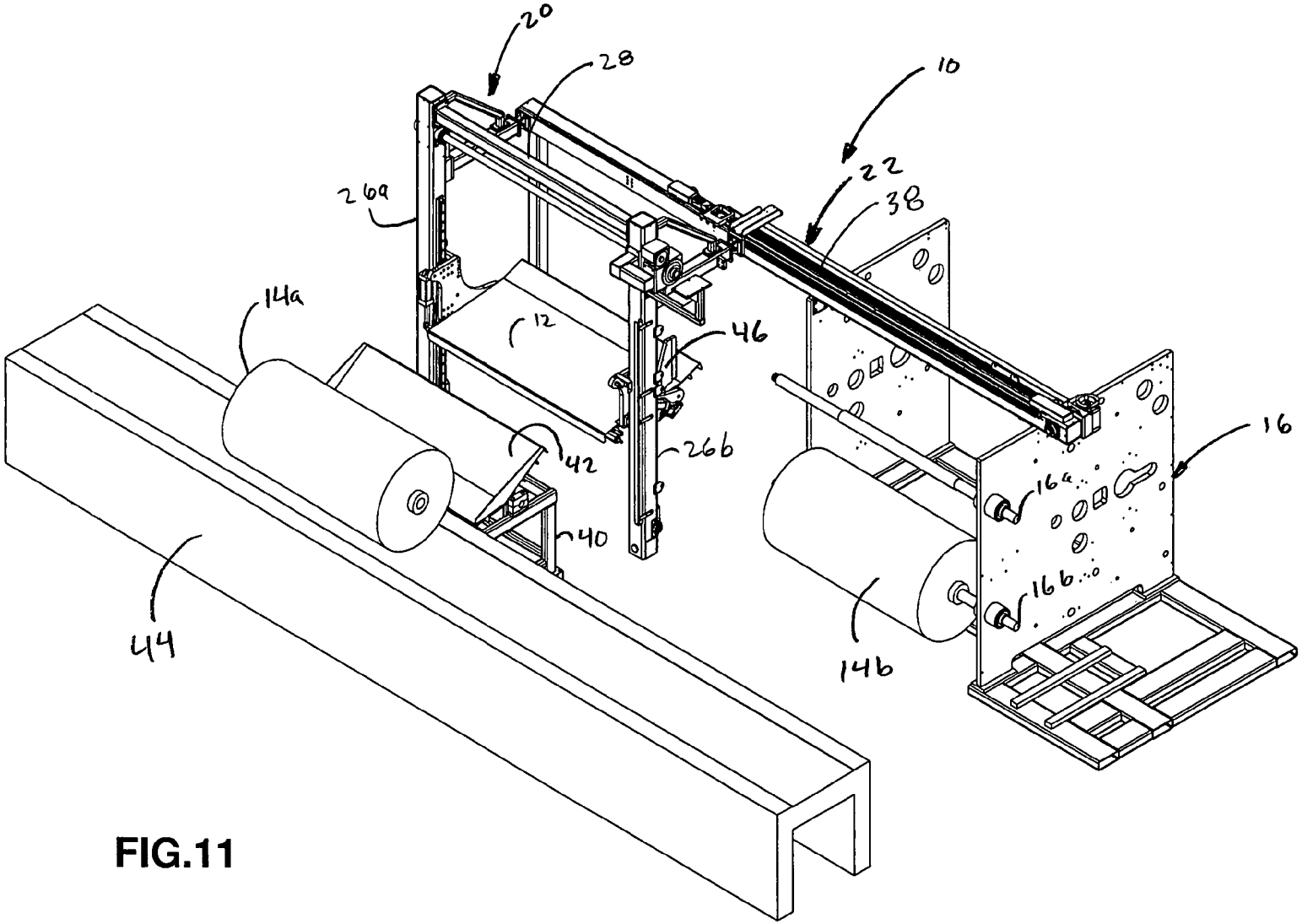
FIG. 11 is an isometric view of the embodiment of FIG. 1 at an eleventh step of operation.
Figure 12:
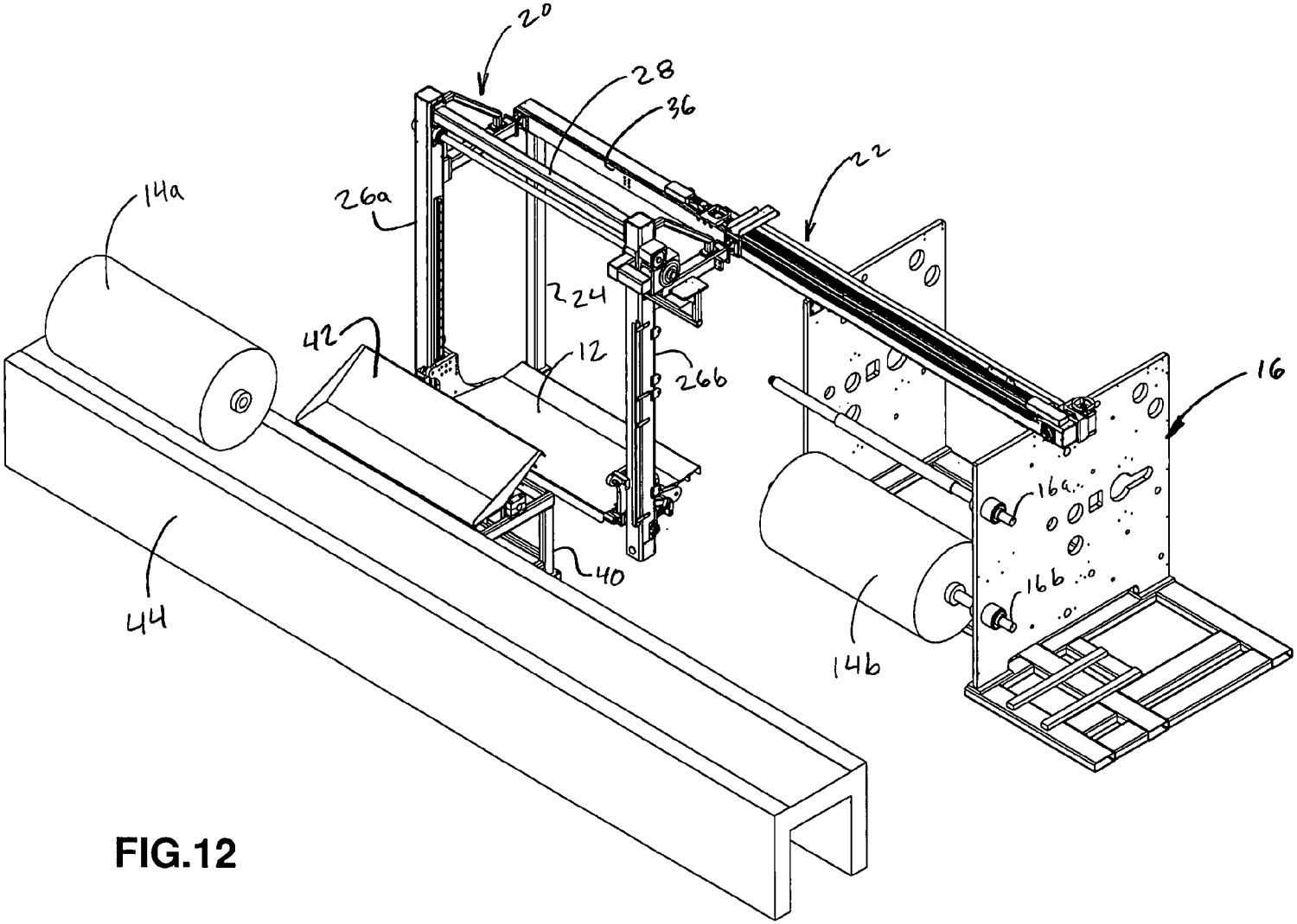
FIG. 12 is an isometric view of the embodiment of FIG. 1 at a twelfth step of operation.

Thereafter, as shown in FIGS. 5 and 6, the cart 40 translates from the rest position adjacent conveyor belt 44 to a receiving position adjacent the unload table 12. Then, if necessary the unload table 12 is lowered to a height compatible with the height of the support table 42 of the roll transfer cart 40. The unload table 12 is then tilted or pivoted downwardly, as shown in FIG. 7, to allow the wound roll 14*a* to transfer from the unload table 12 to the support table 42 of roll transfer cart 40, as shown in FIG. 8. Once the wound roll 14*a* has been deposited on the support table 42, roll transfer cart 40 travels toward the conveyor belt 44 as shown in FIG. 9. Then, as shown in FIG. 10, the support table 42 is tilted downwardly, and the wound roll 14*a* is deposited onto the conveyor belt 44, as shown in FIG. 11. The conveyor belt 44 then moves the wound roll 14*a* to another location for further processing, as shown in FIG. 12.

Figure 13:
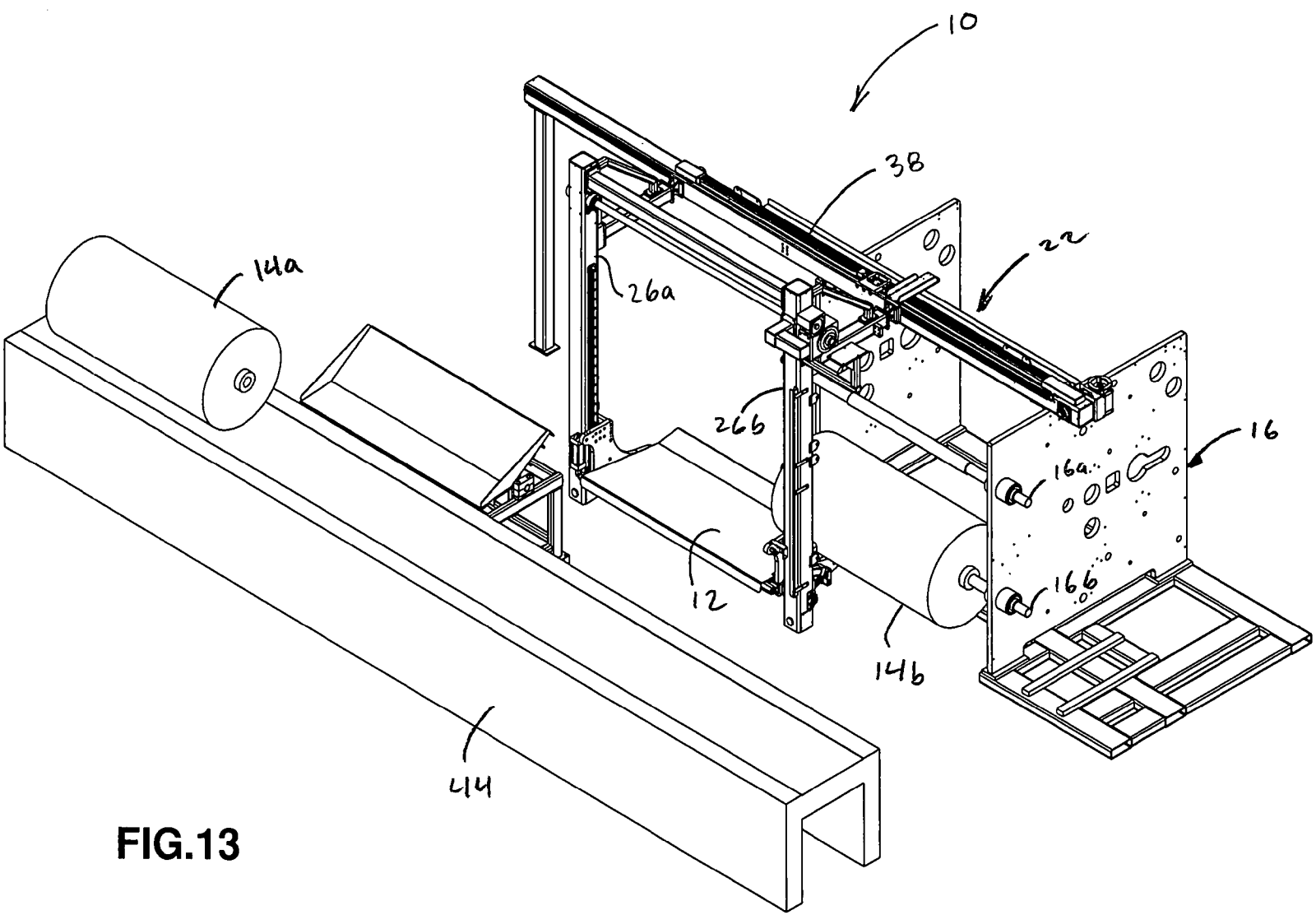
FIG. 13 is an isometric view of the embodiment of FIG. 1 at a thirteenth step of operation.
Figure 14:
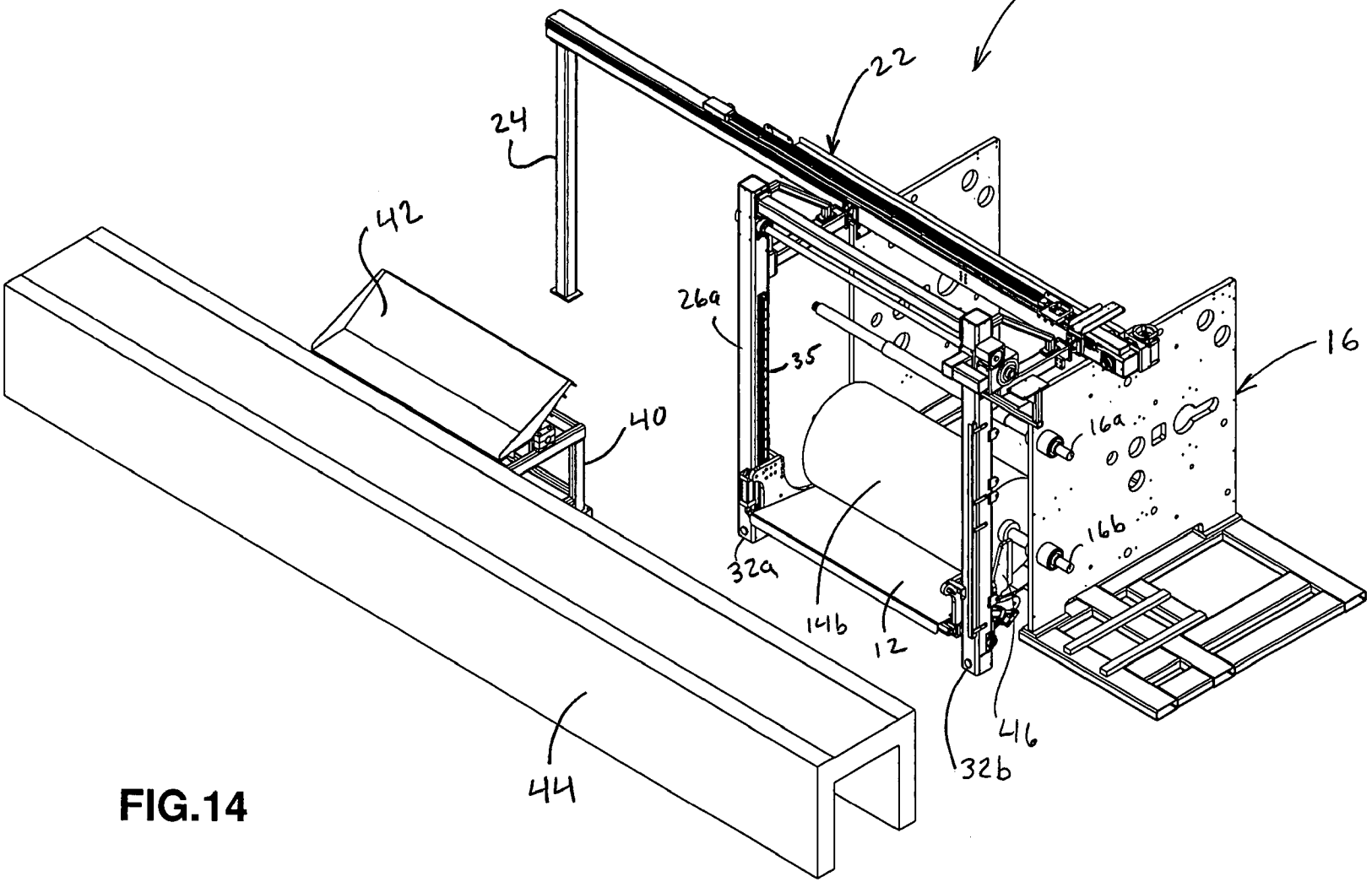
FIG. 14 is an isometric view of the embodiment of FIG. 1 at a fourteenth step of operation.
Figure 15:
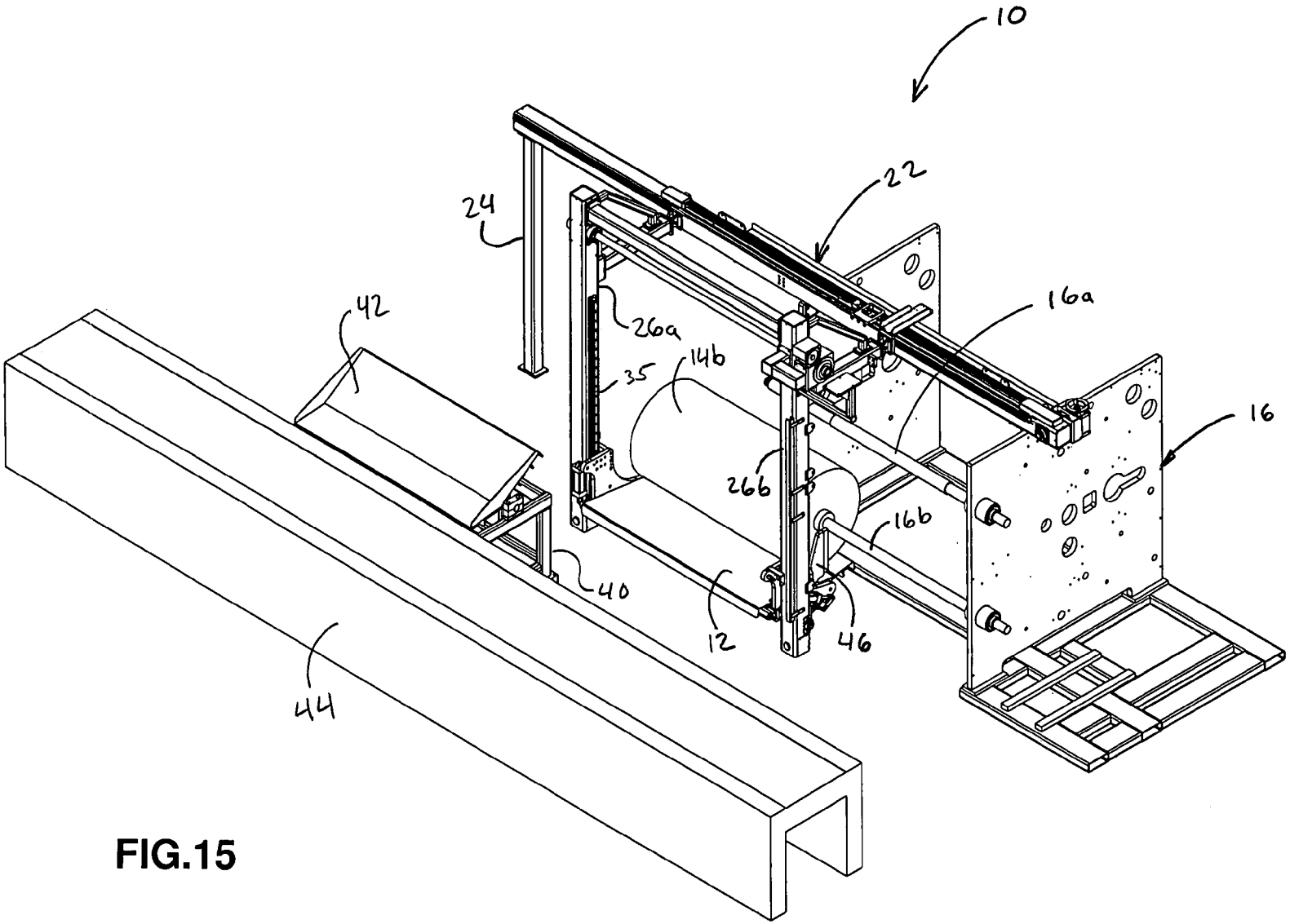
FIG. 15 is an isometric view of the embodiment of FIG. 1 at a fifteenth step of operation.
Figure 16:
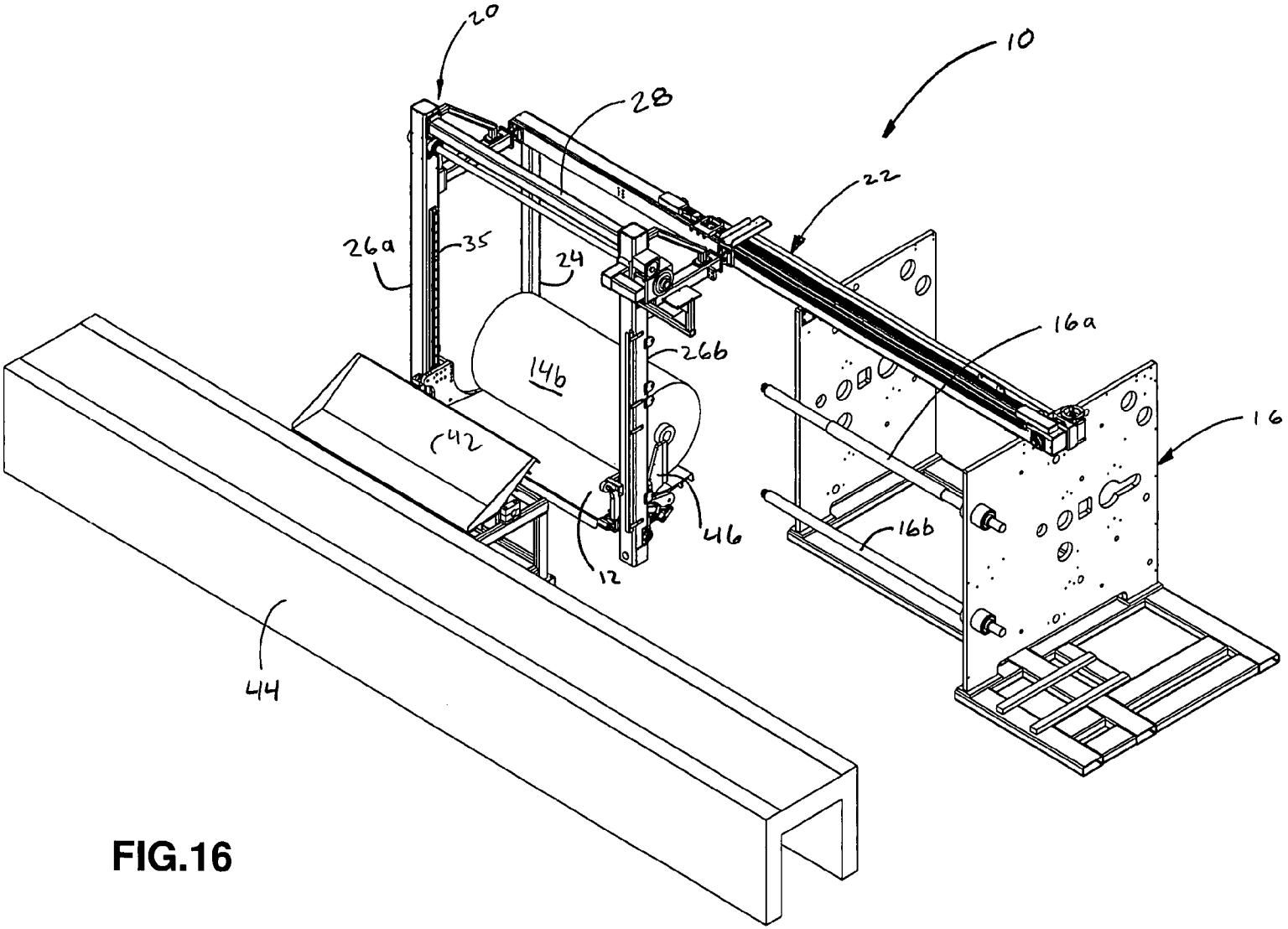
FIG. 16 is an isometric view of the embodiment of FIG. 1 at a sixteenth step of operation.
Figure 17:
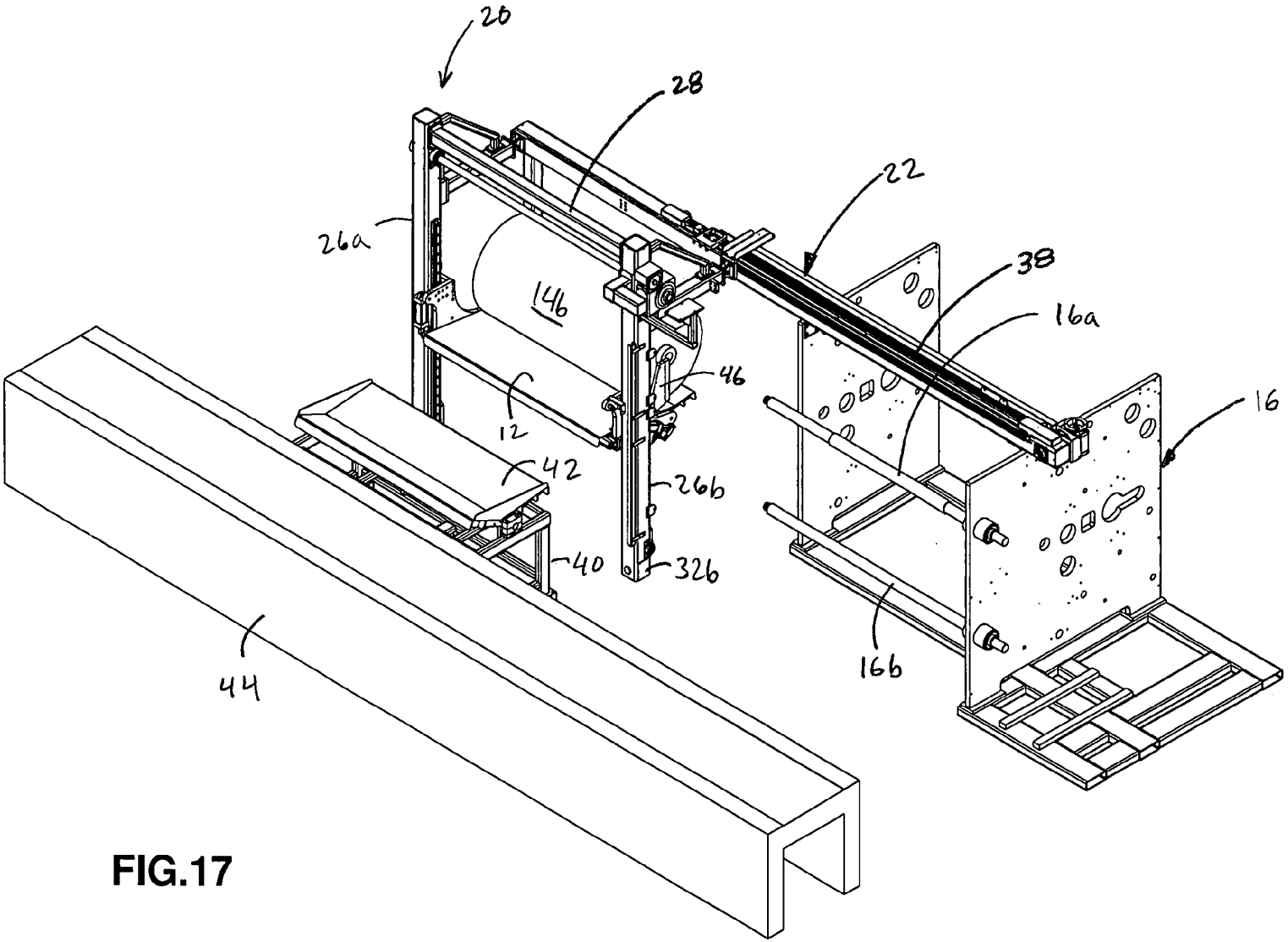
FIG. 17 is an isometric view of the embodiment of FIG. 1 at a seventeenth step of operation.
Figure 18:
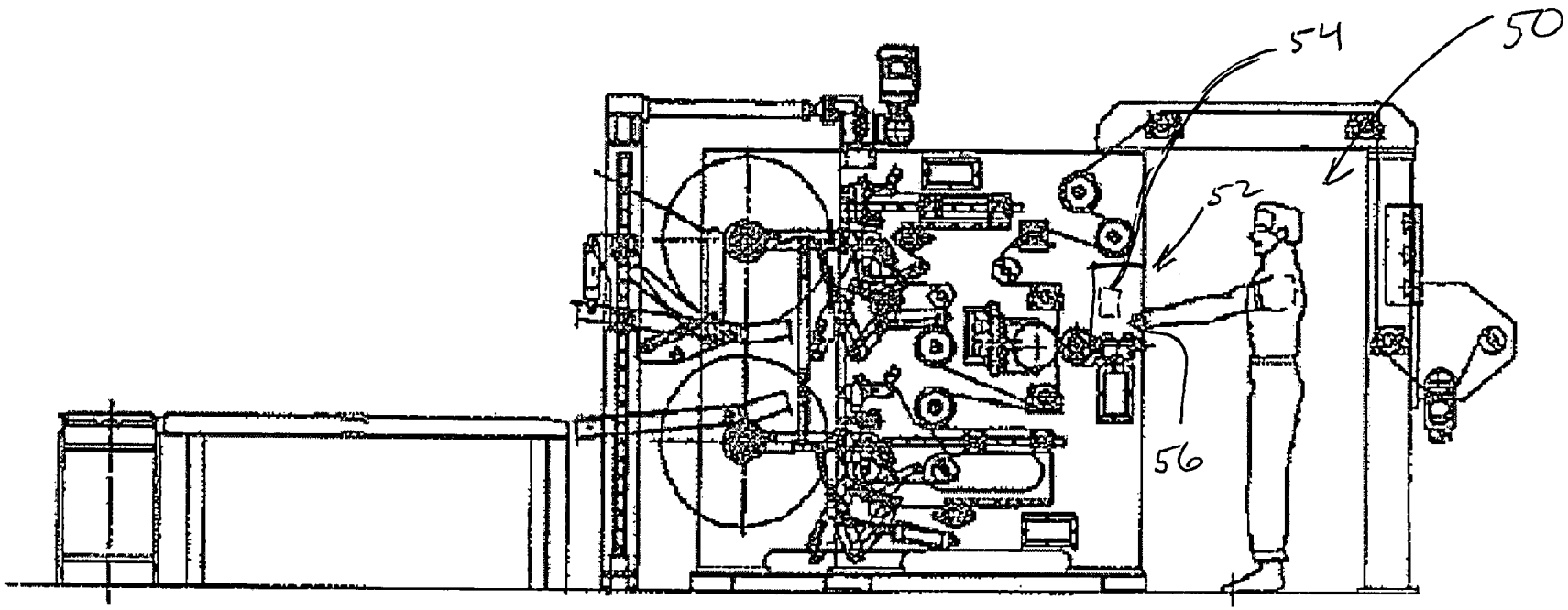
FIG. 18 is a side view of a portion of a device made in accordance with the invention depicting an operator station.

Thereafter, as shown in FIG. 13, the unload sequence is repeated, with respect to wound roll 14*b* supported on lower mandrel 16*b*. Accordingly, the roll pusher arm 46 (see FIG. 8) is retracted into a non-operative position and the unload table 12 is lowered to a height that permits it to be moved below wound roll 14*b*. Once the unload table 12 is properly positioned below the wound roll 14*b*, the roll pusher arm 46 is pivoted into an operative position as shown in FIG. 14. The unload table 12 is then adjusted appropriately with respect to the lower elongate mandrel 16*b*, and the unload table 12 translates laterally away from the rewind stand 16 to begin stripping roll 14*b* from elongate mandrel 16*b*, as shown in FIG. 15. After roll 14*b* has been completely stripped and fully supported on unload table 12 as shown in FIG. 16, the unload table 12 is raised to a height compatible with the support table 42 of roll transfer cart 40, as shown in FIG. 17. The cart 40 then travels to the unload table 12 and the wound roll 14*b* is deposited onto the support table 42 in the same manner described above with respect to FIGS. 6 through 8.

Those skilled in the art will readily appreciate that full-width rolls supported on the mandrels of the rewind stand 16 would be unloaded in the same manner as the multiple-cut rolls 14*a*, 14*b* illustrated and described herein. It is also envisioned that the V-shaped unload table 12 and the V-shaped support table 42 of roll transfer cart 40 could be cushioned to protect the outer surface of the rolled material during the unloading process.

It is also envisioned and well within the scope of the subject disclosure that the material handling system 10 can be provided with a stationary support table rather than the moveable roll transfer cart 40 for receiving wound rolls from the unload table 12. Alternatively, the system 10 could be arranged and configured so that the unload table 12 could deposit wound rolls of finished material directly onto the conveyor belt 44, without requiring a separate support table or cart.

In another embodiment of the subject invention (and as depicted in FIG. 19), the material handling system can include two separate unload tables, including an upper unload table for handling the upper wound roll 14*a* and a lower unload table for handling the lower wound roll 14*b*. Thus, both mandrels 16*a*, 16*b* can be unloaded simultaneously. This would result in higher productivity for the rewind stand. In such an instance the unload tables could deposit rolls on the cart one at a time. It is also envisioned that each unload table could either have its own independent lift and tilt mechanism, or the two unload tables could share a common lift mechanism, provided there was a sufficient amount of clearance to accommodate such an arrangement.

In yet another embodiment of the subject invention, the unload table 12 could be long enough to support all of the plurality of rolls 14*a* and 14*b* at the same time. In this embodiment, the roll pusher arm 46 can push the rolls 14*a* to one end of the unload table 12, making room so that the unload table 12 could proceed to collect the rolls of 14*b* before depositing the all of the rolls 14*a* and 14*b* onto the cart 40 at the same time. This embodiment thus reduces the number of trips for the roll transfer cart 40 in half.

Those skilled in the art will readily appreciate that the linear drive systems described herein associated with the height adjustable and laterally moving unload table 12, as well as the movable roll transfer cart 40, and pusher arm 46 can employ electric motors, hydraulics or pneumatics depending upon the application requirements and design constraints of the system and its operating environment.

The methods and systems of the present invention, as described herein above and shown in the drawings, provide for an apparatus for unloading rolled material from a cantilevered support mandrel, the apparatus having superior properties including unloading the rolled material without requiring the support mandrel to cantilever the rolled material, and without requiring the support mandrel to retract. It will be apparent to those skilled in the art that various modifications and variations can be made on the device and method of the present invention without departing from the spirit or scope of the invention. Thus, it is intended that the present invention include modifications and variations that are within the scope of the appended claims and their equivalents.

What is claimed is:

1. An apparatus for unloading rolled material from a cantilevered support mandrel defining a first axis, comprising:

a) a first guide rail extending generally parallel to the cantilevered support mandrel;

b) a second guide rail extending generally perpendicularly to the cantilevered support mandrel;

c) a third guide rail, wherein the third guide rail is generally parallel to the second guide rail;

d) a carrier for receiving rolled material from the mandrel, the carrier being adapted and configured for movement along the first and second guide rails, the carrier defining a longitudinal axis and having a first end and a second end opposed to the first end along the longitudinal axis of the carrier, wherein the first and second ends of the carrier are operatively and pivotally connected to the second and third guide rails, respectively, so that the carrier is supported between the second and third guide rails and pivotally about said longitudinal axis; and e) a roll pusher arm operatively connected to the carrier operative to strip rolled material from the cantilevered support mandrel, wherein the roll pusher arm is configured for movement independent of the mandrel between a first retracted position and a second operative position beside rolled material on the mandrel.

2. The apparatus of claim 1, wherein the carrier is adapted and configured for generally vertical movement along the second and third guide rails.

3. The apparatus of claim 2, wherein each of the second and third guide rails are movably supported by a caster.

4. The apparatus of claim 3, further comprising a track adapted and configured to guide each caster.

5. The apparatus of claim 1, wherein the carrier includes a platform having a first end pivotally coupled to the second guide rail.

6. The apparatus of claim 5, wherein the platform is concave.

7. The apparatus of claim 1, wherein the carrier is adapted and configured to be positioned underneath the rolled material to facilitate removal of the rolled material from the cantilevered support mandrel.

8. The apparatus of claim 1, further comprising a control panel, the control panel including a user interface and a programmable controller, the controller being programmable to remove the rolled material from the mandrel using the carrier.

9. The apparatus of claim 1, wherein the controller is programmable to eject the rolled material from the carrier.

10. The apparatus of claim 9, wherein the apparatus further comprises a roll transfer cart adapted to transport the rolled material from the roll transfer apparatus to a location remote from the roll transfer apparatus, wherein the controller is programmable to eject the rolled material from the carrier onto the cart.

11. The apparatus of claim 1, wherein the first guide rail is operably coupled to the second guide rail.

12. The apparatus of claim 11, wherein the first guide rail is operably coupled to the second guide rail by a strut.

13. The apparatus of claim 1, wherein the apparatus is adapted and configured to remove rolled material from a plurality of mandrels.

14. The apparatus of claim 13, wherein the carrier is large enough to support material removed from more than one of the plurality of mandrels.

15. The apparatus of claim 13, wherein the apparatus further comprises a second carrier for receiving rolled material from at least one of the mandrels, the second carrier being adapted and configured for movement along the first and second guide rails.

16. The apparatus of claim 15, wherein each carrier can be moved independently with respect to the other carrier.

17. The apparatus of claim 1, wherein the roll pusher arm includes a sensor configured to sense relative positions of the roller pusher arm and rolled material on the mandrel.

18. The apparatus of claim 1, wherein the roll pusher arm is pivotally attached to the carrier.

19. The apparatus of claim 2, wherein the roll pusher arm is pivotally attached to one of the second and third guide rails.

20. An apparatus for unloading rolled material from a cantilevered support mandrel defining a first axis, comprising:

a) a first guide rail extending generally parallel to the cantilevered support mandrel;

b) a second guide rail extending generally perpendicularly to the cantilevered support mandrel;

c) a third guide rail, wherein the third guide rail is generally parallel to the second guide rail;

d) a carrier for receiving rolled material from the mandrel, the carrier being adapted and configured for movement along the first and second guide rails, the carrier including a platform that defines a longitudinal axis and having a first end and a second end opposed to the first end along the longitudinal axis, wherein the first and second ends of the carrier are pivotally coupled to the second and third guide rails, respectively, so that the carrier is supported between the second and third guide rails and pivotally about said longitudinal axis; and e) a roll pusher arm operatively connected to the carrier operative to strip rolled material from the cantilevered support mandrel, wherein the roll pusher arm is pivotally attached to the carrier and is configured for movement independent of the mandrel.

21. The apparatus of claim 20, wherein the platform is concave.

22. An apparatus for unloading rolled material from a cantilevered support mandrel defining a first axis, comprising:

a) a first guide rail extending generally parallel to the cantilevered support mandrel;

b) a second guide rail extending generally perpendicularly to the cantilevered support mandrel;

c) a third guide rail, wherein the third guide rail is generally parallel to the second guide rail;

d) a carrier for receiving rolled material from the mandrel, the carrier being adapted and configured for movement along the first and second guide rails, the carrier defining a longitudinal axis and having a first end and a second end opposed to the first end along the longitudinal axis of the carrier, wherein the first and second ends of the carrier are operatively and pivotally connected to the second and third guide rails, respectively, so that the carrier is supported between the second and third guide rails and pivotally about said longitudinal axis; and e) a roll pusher arm operatively connected to the carrier operative to strip rolled material from the cantilevered support mandrel, wherein the roll pusher arm is pivotally attached to the carrier and is configured for movement independent of the mandrel.

23. An apparatus for unloading rolled material from a plurality of cantilevered support mandrels defining a first axis, comprising:

a) a first guide rail extending generally parallel to the cantilevered support mandrels;

b) a second guide rail extending generally perpendicularly to the cantilevered support mandrels; a third guide rail, wherein the third guide rail is generally parallel to the second guide rail;

c) a first carrier for receiving rolled material from at least one of the mandrels, the first carrier being adapted and configured for movement along the first and second guide rails, the carrier defining a longitudinal axis and having a first end and a second end opposed to the first end along the longitudinal axis of the carrier, wherein the first and second ends of the carrier are operatively and pivotally connected to the second and third guide rails, respectively, so that the carrier is supported between the second and third guide rails and tiltable/pivotable about said longitudinal axis; and d) a second carrier for receiving rolled material from at least one of the mandrels, the second carrier being adapted and configured for movement along the first and second guide rails, wherein each carrier is configured to tilt independently with respect to the other carrier for removing rolled material from the plurality of mandrels.

* * * * *